US012071949B2

(12) United States Patent
Thomes

(10) Patent No.: US 12,071,949 B2
(45) Date of Patent: Aug. 27, 2024

(54) SCREW COMPRESSOR HAVING ROTORS MOUNTED ON ONE SIDE

(71) Applicant: GARDNER DENVER DEUTSCHLAND GMBH, Bad Neustadt (DE)

(72) Inventor: Ulrich Thomes, Kulz (DE)

(73) Assignee: Gardner Denver Deutschland GMBH, Bad Neustadt (DE)

( * ) Notice: Subject to any disclaimer, the term of this patent is extended or adjusted under 35 U.S.C. 154(b) by 0 days.

(21) Appl. No.: 17/799,125

(22) PCT Filed: Feb. 10, 2021

(86) PCT No.: PCT/EP2021/053220
§ 371 (c)(1),
(2) Date: Aug. 11, 2022

(87) PCT Pub. No.: WO2021/160677
PCT Pub. Date: Aug. 19, 2021

(65) Prior Publication Data

US 2023/0071320 A1 Mar. 9, 2023

(30) Foreign Application Priority Data

Feb. 11, 2020 (DE) ..... 102020103384.2

(51) Int. Cl.
*F04C 18/16* (2006.01)
*F04C 2/16* (2006.01)
(Continued)

(52) U.S. Cl.
CPC ..... *F04C 18/16* (2013.01); *F04C 2/16* (2013.01); *F04C 23/001* (2013.01); *F04C 29/04* (2013.01); *F04C 2240/51* (2013.01)

(58) Field of Classification Search
CPC ..... F04C 18/16; F04C 2/16; F04C 23/001; F04C 29/04; F04C 2240/51
See application file for complete search history.

(56) References Cited

U.S. PATENT DOCUMENTS 6,328,540 B1 * 12/2001 Kosters ..... F04C 29/04 417/372
9,624,925 B2 * 4/2017 Christov ..... F01C 21/10
(Continued)

FOREIGN PATENT DOCUMENTS

CN 206903877 U * 1/2018
DE 715860 C 1/1942
(Continued)

OTHER PUBLICATIONS

English Translation EP-2532895-A1 (Year: 2012).*
English Translation CN-206903877-U (Year: 2018).*
English Translation EP-2532895-A1 (Year: 2011).*
(Continued)

*Primary Examiner* — Shafiq Mian
(74) *Attorney, Agent, or Firm* — Kevin E. West; Advent, LLP

(57) ABSTRACT

The invention relates to a screw compressor for compressing a medium, having a drive unit which has a drive, and having a compressor unit which has two mutually engaging rotors with screw profiles, which are complementary to one another, and a compressor housing having an inlet and an outlet. The rotors are coupled to the drive unit via a shaft in each case. The shafts are only mounted on the drive side of the rotors. The rotors are mounted only on one side relative to their axial direction and are not mounted on the side which faces axially away from the drive.
The invention furthermore relates to a screw compressor arrangement with screw compressors which are fluidically connected in series.

18 Claims, 2 Drawing Sheets

(51) Int. Cl.
*F04C 23/00* (2006.01)
*F04C 29/04* (2006.01)

(56) References Cited

U.S. PATENT DOCUMENTS

| | | | | |
|---|---|---|---|---|
| 2002/0141886 | A1* | 10/2002 | Kosters | F04C 29/0085 417/410.5 |
| 2003/0077195 | A1* | 4/2003 | Okada | F04C 29/068 418/83 |
| 2015/0251147 | A1* | 9/2015 | Christov | B29C 48/2522 366/84 |
| 2017/0058901 | A1* | 3/2017 | Collins | F04C 29/04 |
| 2019/0264967 | A1 | 8/2019 | Ju et al. | |
| 2023/0184252 | A1* | 6/2023 | Yamazaki | F04C 18/0215 418/88 |

FOREIGN PATENT DOCUMENTS

| | | | | |
|---|---|---|---|---|
| DE | 2637221 | A1 | 4/1977 | |
| DE | 19522560 | A1 | 1/1997 | |
| DE | 102012001700 | B4 | 9/2013 | |
| DE | 102014002396 | A1 | 8/2015 | |
| DE | 102017007832 | A1 | 2/2019 | |
| EP | 1054160 | A1 | 11/2000 | |
| EP | 1059454 | A1 | 12/2000 | |
| EP | 2532895 | A1 * | 12/2012 | F01C 17/00 |
| FR | 2890418 | A1 | 3/2007 | |

OTHER PUBLICATIONS

Examination Report for German Application No. 102020103384.2, dated Mar. 29, 2023.
PCT International Search Report for PCT/EP2021/053220, dated Mar. 5, 2021.

* cited by examiner

SCREW COMPRESSOR HAVING ROTORS MOUNTED ON ONE SIDE

The invention relates to a screw compressor which can be used to compress media, in particular to provide compressed air. The invention furthermore relates to an arrangement made up of two such screw compressors.

Screw compressors, which are also called rotary compressors or rotary compactors, have two rotors which are arranged parallel to one another (compressor screws) and which have a convex or concave screw profile which engage in one another and convey and compress the medium between the profiles when rotated. The rotors are permanently coupled by a pair of sprockets, for example, but they can also be operated without any coupling, as is the case in compressors with fluid injection. The passage for the medium to be compressed is mechanically sealed at the rolling line between the two rotors. The medium is conveyed in the axial direction of the rotors. Furthermore, in the housing are situated openings for the intake (suction side) and the discharge (pressure side) of the medium.

Hitherto known screw compressors have the disadvantage that a huge effort must be made in structural terms regarding the mounting of the rotors, comparatively high rotational speeds are required and the gap dimensions between the rotors must be kept stable. Furthermore, a great deal of outlay is required in order to adapt the screw compressors to changed operating requirements (pressure, flow rate) since the rotors, the complete rotor housing and the drive unit each have to be redesigned.

The present invention describes providing an improved screw compressor, which has a simplified and thus more inexpensive design and which can be adapted simply to various performance requirements. Furthermore, a multi-stage screw compressor arrangement, which likewise has a simplified design and easier possibilities for adaptation should be provided.

The screw compressor according to the invention serves to compress a medium, in particular gases, preferably to generate compressed air for technical applications. The screw compressor has a drive unit, which has a drive. The drive is preferably a fast-running electrical direct drive, but can also be formed by a number of drives, for example, or by a drive with a transmission gearing. Furthermore, the screw compressor has a compressor unit, which has two mutually engaging rotors with screw profiles which are complementary to one another, and a compressor housing having an inlet (suction side) and an outlet (pressure side). The rotors are coupled to the drive unit via one shaft each, with the rotors and the shafts associated with them also being able to be formed in one piece, but frequently being configured in multiple pieces. The shafts are rotatably mounted in bearings in the drive unit. An important factor in the present invention is that the shafts are mounted only on the drive side of the rotors. The rotors are thus mounted only on one side relative to their axial direction. This is therefore a so-called cantilevered supporting of the rotors or shafts on the side of the rotors. The rotors are not mounted on their side which faces axially away from the drive. As a result, the design is drastically simplified, the number of shaft seals required can be reduced and the construction space is reduced in the axial direction due to the omission of the bearings at the free end of the rotors.

In traditional screw compressors, bearings are disposed on both sides of the rotors. This follows the demand for small gap dimensions between the rotors, the comparatively high rotational speeds required in screw compressors, and the desire for a low degree of wear and great achievable compression of the medium. The invention departs from this path of development and dispenses with the mounting on two sides. It has been shown that the operating parameters of a screw compressor with only one-sided mounting of the rotors nevertheless open up many practical applications and additional advantages can be obtained. In particular, the screw compressor according to the invention allows simple adaptation of the construction size of the screw compressor by adapting the length of the rotors, i.e. rotors of different lengths can be combined with the same drive unit since it is not necessary to change the length of the shafts. Due to the preferred technical component separation between shafts and rotors, these components can be made from different materials, which can contribute to a cost saving and opens up the use of the screw compressors even for the greatest variety of media.

According to an example embodiment, the screw profiles are configured such that, in the operating state, the medium to be compressed is conveyed from that side of the rotors which faces the drive in the direction towards the side facing away from the drive when the rotors are rotated. In particular, the pressure side of the compressor housing is situated on that side of the rotors which faces away from the drive, and has an outlet there. The suction side of the compressor unit is thus situated at the axial end of the rotors which is directed towards the drive unit, or at the radial exterior of the rotors, while the pressure side is at the free, non-mounted end of the rotors. Amongst other things, this has the advantage that the increased pressure is applied on the side of the rotors which faces away from the bearings and the shaft through-holes, which reduces the outlay for the required seals.

In an embodiment, each of the shafts is mounted in the drive unit in at least two axially spaced-apart bearings. The shafts may be mounted in spindle bearings such that a substantially play-free mounting, and thus a high degree of precision in the operating behavior of the rotors, is achieved. Thus, both a high degree of conveying power of the compressor unit and a low degree of wear on the rotors are guaranteed.

In an embodiment, the drive unit and the compressor unit each have cooling channels which carry cooling agent and which, for example, are configured as a cooling jacket in the outer housing section. This reduces both the required construction size of the drive unit and the irrecoverable heat loss. According to an embodiment, the cooling jacket, at the compressor housing, also extends onto the surface of the housing lid, around the outlet (discharge ports), which is advantageous in the case of dry-running rotors which lead to intense heating of the medium. Overall, the employment of cooling channels allows efficient cooling of both the drive unit and the compressor unit and also the recovery of heat, which entails advantages with regard to energy An example embodiment has a bearing unit, which can be a component of the drive unit or which can be constructed in a modularly independent manner. The bearing unit is situated between the drive and the compressor unit, with the shafts running through the bearing unit and bearings positioned there and extending into the compressor unit. Through this modular design, the drive unit can be equipped with different bearing units depending on the application The compressor unit may likewise represents an independent module, which means that this can also be exchanged depending on the relevant application.

In embodiments, the non-mounted ends of the shafts, which extend beyond the drive unit into the compressor unit, are fixed in coaxially running bores of the rotors in a rotationally secure manner. In other embodiments, the ends of the shafts are releasable from the shafts. For example, this occurs by shrinking the rotors onto the ends of the shafts. The shafts can thus be equipped with different rotors without changes to the drive unit.

According to an embodiment, the length:diameter ratio of the rotors is below 1.5, for example, in the range from 0.5 to 1.2 or smaller. Due to the comparatively short rotors, comparatively small forces arise in the radial direction.

The screw compressor arrangement according to the invention includes at least two screw compressors which are fluidically connected in series, wherein a first screw compressor functions as a low-pressure stage and is coupled by its pressure side to the suction side of a second screw compressor, which functions as a high-pressure stage. The first and the second screw compressors are constructed according to the invention according to one of the previously described embodiments.

Further advantages, details and developments of the invention emerge from the following description of embodiments of a screw compressor with reference to the drawings. In the drawings:

FIG. 1 shows an embodiment, by way of example, of a screw compressor according to the invention in a simplified perspective view from the outside, while the details in FIG. 2 are depicted in a cross-sectional view.

Figure 1:
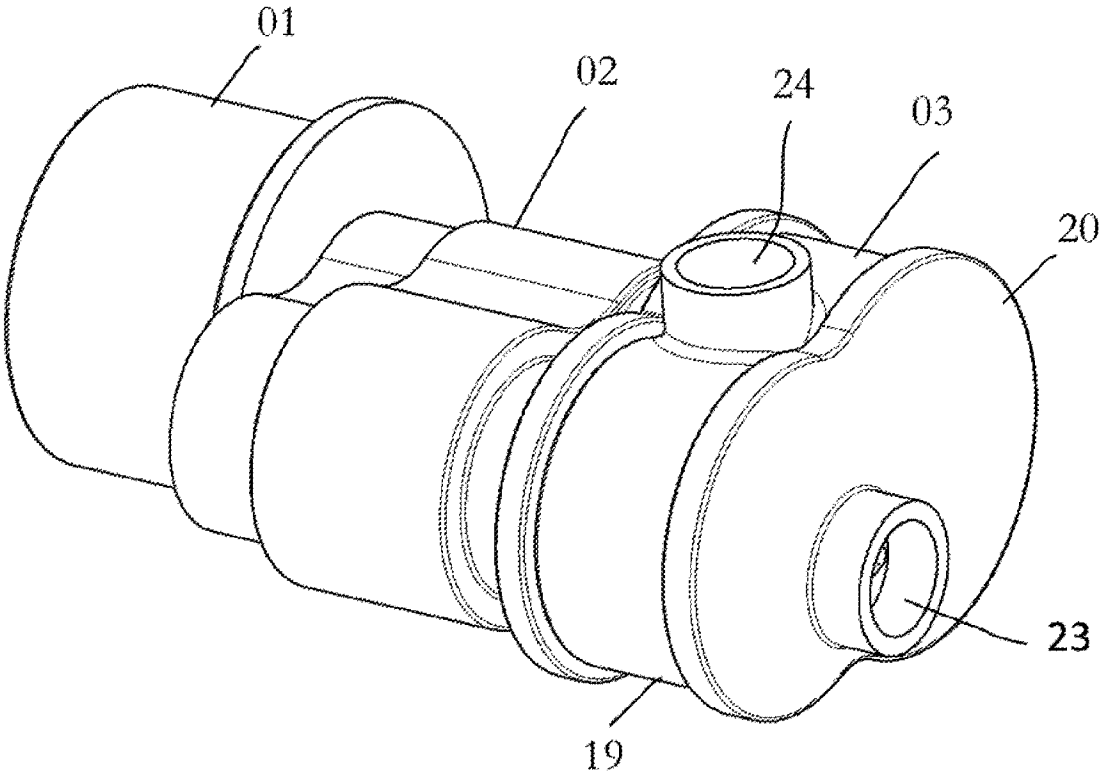
FIG. 1 shows a perspective overall view of a screw compressor according to the invention.
Figure 2:
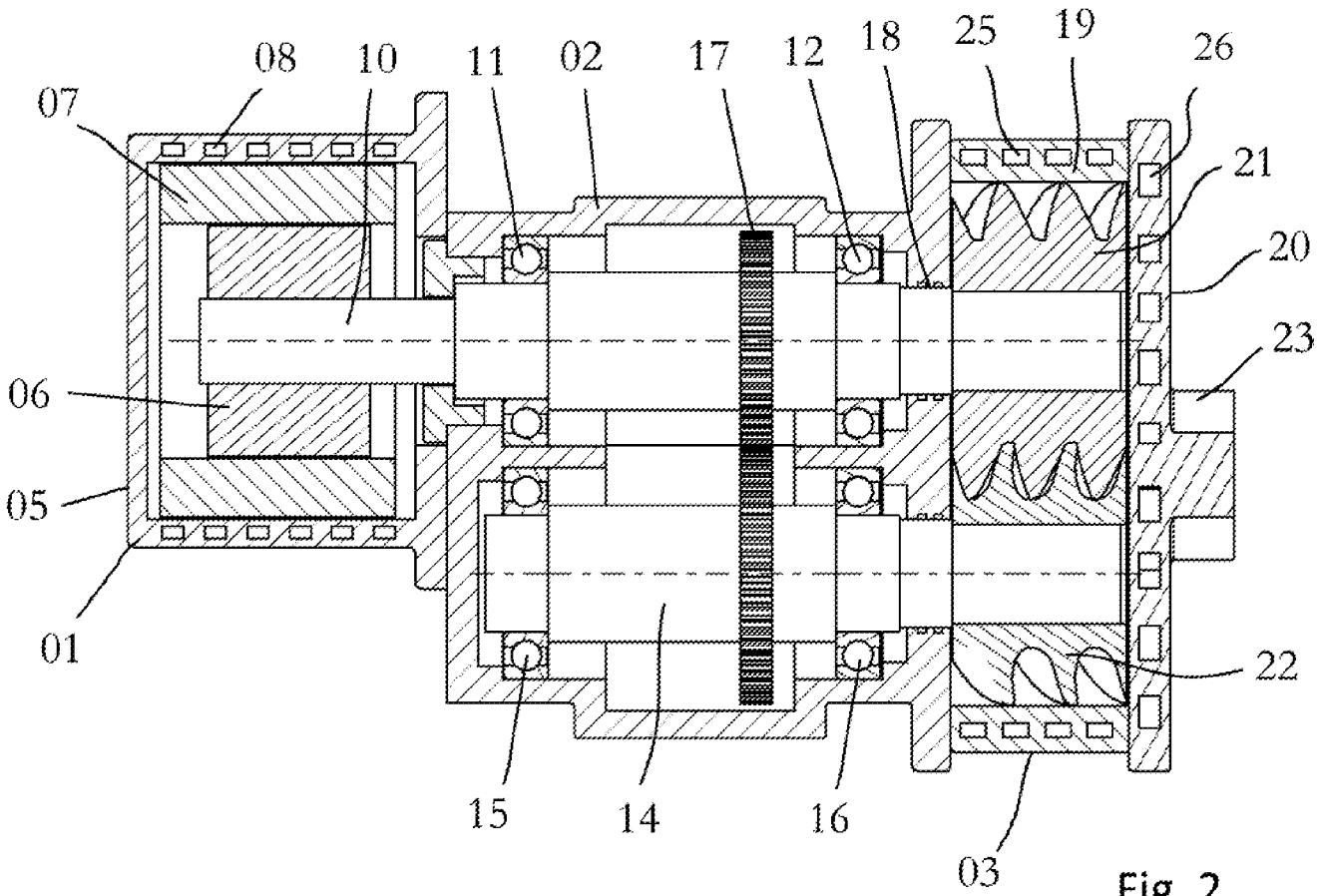
FIG. 2 shows a cross-sectional view of the screw compressor according to FIG. 1.

The screw compressor has a drive unit 01, a bearing unit 02 functionally linked to this, and a compressor unit 03. The bearing unit 02 is situated, when viewed in the axial direction, between the drive unit 01 and the compressor unit 03. The drive unit 01, the bearing unit 02 and the compressor unit 03 are preferably constructed modularly so that they can be put together in a way which is adapted to the relevant application. In particular, however, the drive unit 01 and the bearing unit 02 may also be configured as a structural unit.

The drive unit 01 has a drive housing 05, in which an electrical direct drive with an internally situated drive rotor 06 and an externally situated drive stator 07 are arranged. Furthermore, an external drive cooling jacket 08 is provided with cooling channels through which a cooling agent flows. The drive rotor 06 is connected to a first shaft 10 in order to cause the shaft 10 to rotate. The first shaft 10 is mounted in a first bearing, for example a spindle bearing 11, which is situated axially proximate to the drive rotor 06, and in a second bearing, for example a spindle bearing 12, which is situated in the bearing unit 02.

The drive unit 01 furthermore comprises a second shaft 14 which runs axially parallel to the first shaft 10 and is mounted in a third bearing, for example a spindle bearing 15, in the drive unit 01 and in a fourth bearing, for example a spindle bearing 16, situated in the bearing unit 02. Furthermore, the drive unit 01, for example, in the region of the bearing unit 02, has two gearwheels 17 which are attached to the first and second shafts respectively and serve to synchronously drive the second shaft. The two shafts 10, 14 can preferably be made of tempered steel. The shafts are guided into the compressor unit 03 through seals 18.

The compressor unit 03 has a compressor housing 19 with a housing lid 20 on the axial end face facing away from the bearing unit 02. Inside the compressor housing 19, there are situated a main rotor 21 and a subsidiary rotor 22 which are positioned axially parallel to one another and bear mutually complementary, mutually engaging screw profiles. The rotors remain easily accessible for maintenance purposes, via the housing lid which is intended to be opened. The two rotors 21, 22 can, for example, consist of ceramic material, carbon or steel and do not have to be manufactured out of the same material as the shafts 10, 14, which expands the areas of application of the screw compressor.

The first shaft 10 engages by its free end in a coaxial bore of the main rotor 21, while the second shaft 14 engages by its free end in a coaxial bore of the subsidiary rotor 22. The shafts 10, 14 thus drive the rotors 21, 22. The rotors 21, 22 are not mounted on the side of the rotors 21, 22 facing the housing lid 20. Between the end faces of the rotors 21, 22 and the inside of the housing lid 20, a pressure chamber in which the rotors 21, 22 convey the medium when they are rotated is formed. The housing lid 20 has an outlet 23 at which the medium is discharged. Furthermore, at the compressor housing 19, there is provided an inlet 24 via which the medium is sucked in. Through the dimensioning of the outlet 23, it is possible to set the pressure to be achieved on the pressure side of the screw compressor. If the screw compressor is to be adapted to a changed application, for example, the housing lid can be exchanged, with a changed outlet being provided in order to adapt the outlet pressure provided by the screw compressor.

Finally, the compressor unit 03 has a compressor cooling jacket 25 which in turn comprises cooling channels in which the cooling agent flows. Preferably, cooling channels 26 which carry cooling agent and which are preferred components of the compressor cooling jacket 25 also continue in the housing lid 20. In this manner, the pressure chamber, which is formed on the pressure side of the rotors, can be cooled efficiently.

REFERENCE NUMBERS

01—drive unit
02—bearing unit
03—compressor unit
04—
05—drive housing
06—drive rotor
07—drive stator
08—drive cooling jacket
09—
10—first shaft
11—first spindle bearing
12—second spindle bearing
13 —
14—second shaft
15—third spindle bearing
16—fourth spindle bearing
17—gearwheels
18—seals
19—compressor housing
20—housing cover
21—main rotor
22—subsidiary rotor
23—outlet
24—inlet
25—compressor cooling jacket
26—cooling channels

The invention claimed is:

1. A screw compressor assembly for compressing a fluid medium comprising:

a drive unit configured to drive a first shaft and a second shaft, the first shaft defining a first axis of rotation and the second shaft defining a second axis of rotation, the first axis of rotation parallel to the second axis of rotation, the first shaft having a first end and a second end, the first end configured to be directly driven by the drive unit;

a compressor unit including a compressor housing, a main rotor and a subsidiary rotor, the main rotor and the subsidiary rotor having mutually engaging screw profiles and positioned parallel from each other, the first shaft rotatably driving the main rotor around the first axis of rotation and the second shaft rotatably driving the subsidiary rotor around the second axis of rotation; and a bearing unit disposed between the drive unit and the compressor unit, the bearing unit housing the first shaft and the second shaft and including a pair of gearwheels, each one of the pair of gearwheels respectively coupled to the first shaft and the second shaft and configured to synchronously drive the second shaft with respect to the first shaft;

wherein the main rotor and the subsidiary rotor are respectively mounted to the first shaft and the second shaft on a first axial direction, the first axial direction facing the drive unit.

2. The screw compressor assembly of claim 1, wherein the bearing unit includes a first bearing, a second bearing, a third bearing, and a fourth bearing, the first bearing and the second bearing supporting the first shaft and the third bearing and the fourth bearing supporting the second shaft.

3. The screw compressor assembly of claim 2, wherein the second shaft has a first end and a second end, where the third bearing is configured to support the first end of the second shaft, and the second end of the second shaft is configured to drive the subsidiary rotor.

4. The screw compressor assembly of claim 1, wherein the drive unit, the bearing unit, and the compressor unit are modular, separate units from one another.

5. The screw compressor assembly of claim 1, wherein the compressor unit is housed within a compressor unit housing, the compressor unit housing including a housing lid covering the main rotor and the subsidiary rotor from a second axial direction, the second axial direction facing away from the drive unit.

6. The screw compressor assembly of claim 5, wherein the compressor housing includes an inlet and an outlet, the inlet disposed on the compressor housing transversely from the first axis of rotation and the second axis of rotation and the outlet disposed on the housing lid, axially from the first axis of rotation and the second axis of rotation.

7. The screw compressor assembly of claim 5, wherein the unit housing includes a cooling jacket having a plurality of cooling channels, the cooling channels carrying a cooling agent configured to cool a pressurized medium being delivered by the compressor unit.

8. The screw compressor assembly of claim 5, wherein the cooling jacket covers the housing lid.

9. The screw compressor assembly of claim 1, wherein the main rotor and the subsidiary rotor respectively have a length to diameter ratio between 0.2 and 1.2.

10. A screw compressor assembly for compressing a fluid medium comprising:

a drive unit configured to drive a first shaft and a second shaft, the first shaft defining a first axis of rotation and the second shaft defining a second axis of rotation, the first axis of rotation parallel to the second axis of rotation, the first shaft configured to be directly driven by the drive unit;

a compressor unit including a compressor housing, a main rotor and a subsidiary rotor, the first shaft rotatably driving the main rotor around the first axis of rotation and the second shaft rotatably driving the subsidiary rotor around the second axis of rotation;

a first gearwheel and a second gearwheel, the first gearwheel coupled to the first shaft and the second gearwheel coupled to the second shaft; and a bearing unit disposed between the drive unit and the compressor unit, the bearing unit housing the first shaft, the second shaft, the first gearwheel and the second gearwheel, the bearing including a first bearing, a second bearing, a third bearing, and a fourth bearing, the first bearing and the second bearing supporting the first shaft and the third bearing and the fourth bearing supporting the second shaft;

wherein the second gearwheel and the first gearwheel are configured to synchronously drive the second shaft with respect to the first shaft.

11. The screw compressor assembly of claim 10, wherein the second shaft has a first end and a second end, where the third bearing is configured to support the first end of the second shaft, and the second end of the second shaft is configured to drive the subsidiary rotor.

12. The screw compressor assembly of claim 10, wherein the drive unit, the bearing unit, and the compressor unit are modular, separate units from one another.

13. The screw compressor assembly of claim 10, wherein the main rotor and the subsidiary rotor are respectively mounted to the first shaft and the second shaft on a first axial direction, the first axial direction facing the drive unit.

14. The screw compressor assembly of claim 10, wherein the compressor unit is housed within a compressor unit housing, the compressor unit housing including a housing lid covering the main rotor and the subsidiary rotor from a second axial direction, the second axial direction facing away from the drive unit.

15. The screw compressor assembly of claim 14, wherein the compressor housing includes an inlet and an outlet, the inlet disposed on the compressor housing transversely from the first axis of rotation and the second axis of rotation and the outlet disposed on the housing lid, axially from the first axis of rotation and the second axis of rotation.

16. The screw compressor assembly of claim 14, wherein the unit housing includes a cooling jacket having a plurality of cooling channels, the cooling channels carrying a cooling agent configured to cool a pressurized medium being delivered by the compressor unit.

17. The screw compressor assembly of claim 14, wherein the cooling jacket covers the housing lid.

18. The screw compressor assembly of claim 10, wherein the main rotor and the subsidiary rotor respectively have a length to diameter ratio between 0.2 and 1.2.

* * * * *